US007975868B1

(12) United States Patent
Flies et al.

(10) Patent No.: US 7,975,868 B1
(45) Date of Patent: Jul. 12, 2011

(54) COMPARTMENTALIZED BEVERAGE CONTAINER

(76) Inventors: Matthew B. Flies, Midwest City, OK (US); Daniel Chad Strickland, Midwest City, OK (US)

( * ) Notice: Subject to any disclaimer, the term of this patent is extended or adjusted under 35 U.S.C. 154(b) by 979 days.

(21) Appl. No.: 11/899,277

(22) Filed: Sep. 5, 2007

Related U.S. Application Data

(63) Continuation-in-part of application No. 10/824,830, filed on Apr. 15, 2004, now abandoned.

(51) Int. Cl.
*B65D 1/04* (2006.01)

(52) U.S. Cl. ..... 220/524; 215/6; 215/12.1

(58) Field of Classification Search ..... 215/6, 13.1, 215/10, 12.1; 220/524, 526, 254.2
See application file for complete search history.

(56) References Cited

U.S. PATENT DOCUMENTS

| | | | | |
|---|---|---|---|---|
| 1,329,975 | A | 2/1920 | Kines | |
| 2,033,042 | A | 3/1936 | Mazzella | |
| 2,399,665 | A | 5/1946 | Deardorff | |
| 3,081,926 | A * | 3/1963 | Newton | 229/5.6 |
| 3,258,369 | A * | 6/1966 | Blaich | 429/185 |
| 3,677,524 | A * | 7/1972 | Douglas | 366/130 |
| 3,705,661 | A * | 12/1972 | Davis | 215/6 |
| 3,971,304 | A | 7/1976 | Cvitkovich | |
| 4,301,942 | A * | 11/1981 | Kupperman et al. | 220/592.17 |
| 4,856,995 | A | 8/1989 | Wagner | |
| 4,955,503 | A | 9/1990 | Propes | |
| 5,038,948 | A | 8/1991 | Signorini | |
| 5,040,317 | A * | 8/1991 | Kadjevich | 40/324 |
| 5,143,261 | A * | 9/1992 | Drobish | 222/129 |
| 5,223,245 | A * | 6/1993 | Ibrahim et al. | 424/44 |
| 5,588,550 | A | 12/1996 | Meyer | |
| 5,881,918 | A * | 3/1999 | Eichler | 222/135 |
| 5,954,213 | A | 9/1999 | Gerhart | |
| 6,089,389 | A | 7/2000 | Sharon | |
| 6,105,812 | A | 8/2000 | Riordan | |
| 6,283,316 | B1 * | 9/2001 | Sherman | 215/6 |
| 6,390,324 | B1 | 5/2002 | Everette | |
| 6,419,108 | B1 | 7/2002 | Toida | |
| 6,450,351 | B1 | 9/2002 | Thompson | |
| 6,499,614 | B1 * | 12/2002 | Thompson | 215/6 |
| 6,575,323 | B1 * | 6/2003 | Martin et al. | 220/254.3 |
| 2005/0127100 | A1 * | 6/2005 | Reggiani | 222/135 |

* cited by examiner

*Primary Examiner* — Sue A Weaver
(74) *Attorney, Agent, or Firm* — Randal D. Homburg

(57) ABSTRACT

A beverage container having at least two separate and distinct compartments separated by a vertical partition allows for the container to retain separate liquids within an inner liner provided within an outer contoured shell with an air space between the inner liner and outer container providing insulation of the inner liner, the container further providing a fitted lid having a sealing gasket on the underside of the lid to maintain segregation of the liquids in the distinct compartments when consuming the beverage through the fitted lid, with the fitted lid further having an opening containing a locking closure over each distinct compartment to select which of the contained beverage would be consumed at one time.

6 Claims, 4 Drawing Sheets

COMPARTMENTALIZED BEVERAGE CONTAINER

CROSS REFERENCE TO RELATED APPLICATIONS

This is a Continuation-in-Part Application of application Ser. No. 10/824,830 filed on Apr. 15, 2004 now abandoned by the same inventors, and therefore claims the benefit of the previous application filing date, in part.

I. BACKGROUND OF THE INVENTION

1. Field of Invention

A beverage container having at least two separate and distinct compartments separated by a vertical partition allows for the container to retain separate liquids within an inner liner provided within an outer contoured shell with an air space between the inner liner and outer container providing insulation of the inner liner, the container further providing a fitted lid having a sealing gasket on the underside of the lid to maintain segregation of the liquids in the distinct compartments when consuming the beverage through the fitted lid, with the fitted lid further having an opening containing a locking closure over each distinct compartment to select which of the contained beverage would be consumed at one time.

2. Description of Prior Art

The following United States patents were discovered and are disclosed within this application for utility patent. All relate to beverage containers, some having multiple compartments.

In U.S. Pat. No. 6,450,351 to Thompson, a dual compartment container is disclosed having a vertical partition with a lid having a means to select which internal compartment is open to consume a beverage contained therein. U.S. Pat. No. 6,419,108 to Toida discloses a beverage container having an outer member with an inner member contained within the outer member providing an air chamber intended to provide insulation between the inner and outer members. Another dual chambered beverage container is disclosed in U.S. Pat. No. 5,954,213 to Gerhart which includes a vertical separator having a removable lid which dispenses the separate contents contemporaneously.

In U.S. Pat. No. 5,588,550 to Meyer, a dual chambered beverage container includes a lid which has a rotatable opening allowing dispensing of a contained liquid to the exclusion of other liquids contained in other chambers of the container. The lid contains a sealing means at the top of the partitions to apply a seal between the lid, the partition and the container. A drinking cup with a vertical partition and a lid having a seal means on the underside to form a seal between the lid and the partition and another seal between the lid and the container includes two openings having retractable flaps to seal a straw opening is the disclosed subject matter of U.S. Pat. No. 4,955,503 to Propes.

A nursing bottle provides a dual chambered inner insert within an outer container having a multiple pieced lid assembly which allow for and handle within the lid to be move to dispense one of the selected separate chambers, the bottle having a seal within the nipple to prevent the contents from spilling from the bottle unless the nipple is compressed to release the contents. U.S. Pat. No. 2,033,042 to Mazzella discloses a lid upon a container which includes a rotatable lever having rubber buttons fitted within adapted openings to dispense contents from each side of the lid.

None of the above patents, alone or in combination disclose the material elements of the present compartmentalized beverage container, nor would they appropriately combine to form the combined elements of the present beverage container.

II. SUMMARY OF THE INVENTION

Beverage containers come in basically every shape, size and configuration. They also provide a variety of thermal characteristics, being insulated, sealed, compartmentalized and having any number of different shaped and functional lids, especially directed to means of closure. They are provided in an assortment of materials, including metal, plastic and styrofoam, and may be reused or disposable. Some may be intended to keep contained beverages hot and some are intended to keep them cold and many are designed to keep the contents sealed even when the container is jostled or overturned.

As is well known, a beverage seeks an ambient temperature when exposed to the environment. If it is hot, it will cool, and if it is cold, it will warm up to eventually seek a temperature the same as its surroundings. Consumption accelerates that thermal transition as well as leaving the beverage open to the surrounding environment. Many beverages consumers will purchase a beverage and due to extrinsic factors such as work or travel, cannot consumer the beverage in time to enjoy the preferred drinking temperature, and a large amount of the beverage is simply tossed out as waste, meaning the consumer has not consumed all that they paid for.

The present compartmentalized beverage container allows for a beverage to be purchased and dispensed into at least two separate and distinct compartments separated by a fixed vertical partition within an inner liner contained within an outer liner, with a removable lid affixed to the top of the inner liner, segregating the two compartments from one another by a conforming seal incorporated into the lower surface of the lid, the lid having two independently opening tabs attached to individual hinges to the upper surface of the lid, each tab having an insertion member adapted to fit securely within a lid opening positioned over each separate compartment, wherein a selected tab may be opened for the consumption of a beverage within the corresponding compartment, leaving the other compartment completely closed and sealed to retain the temperature of the beverage within that other compartment until that beverage is to be consumed.

The primary objective of the invention is to provide a compartmentalized beverage container providing separate compartments within a beverage container for two separate beverages to retain the thermal integrity of the each beverage and to allow the preservation of the beverage temperature in the unconsumed beverage compartment during the consumption of the other beverage. A second objective is to provide the container with the at least two separate beverage compartments with a vertical partition dividing an inner liner fitted within an outer container into separate compartments and providing a lid having a seal to completely segregate the two compartments from one another. A third objective is to provide the beverage container having thermal insulation properties and a removable lid for ease of cleaning and for ease of filling the container. A fourth objective is to provide the lid with an independent opening means over each segregated compartment below the lid for the consumption of a beverage in a selected compartment while keeping the unconsumed beverage compartment closed

III. DESCRIPTION OF THE DRAWINGS

The following drawings are submitted with this utility patent application.

IV. DESCRIPTION OF THE PREFERRED EMBODIMENT

Figure 3:
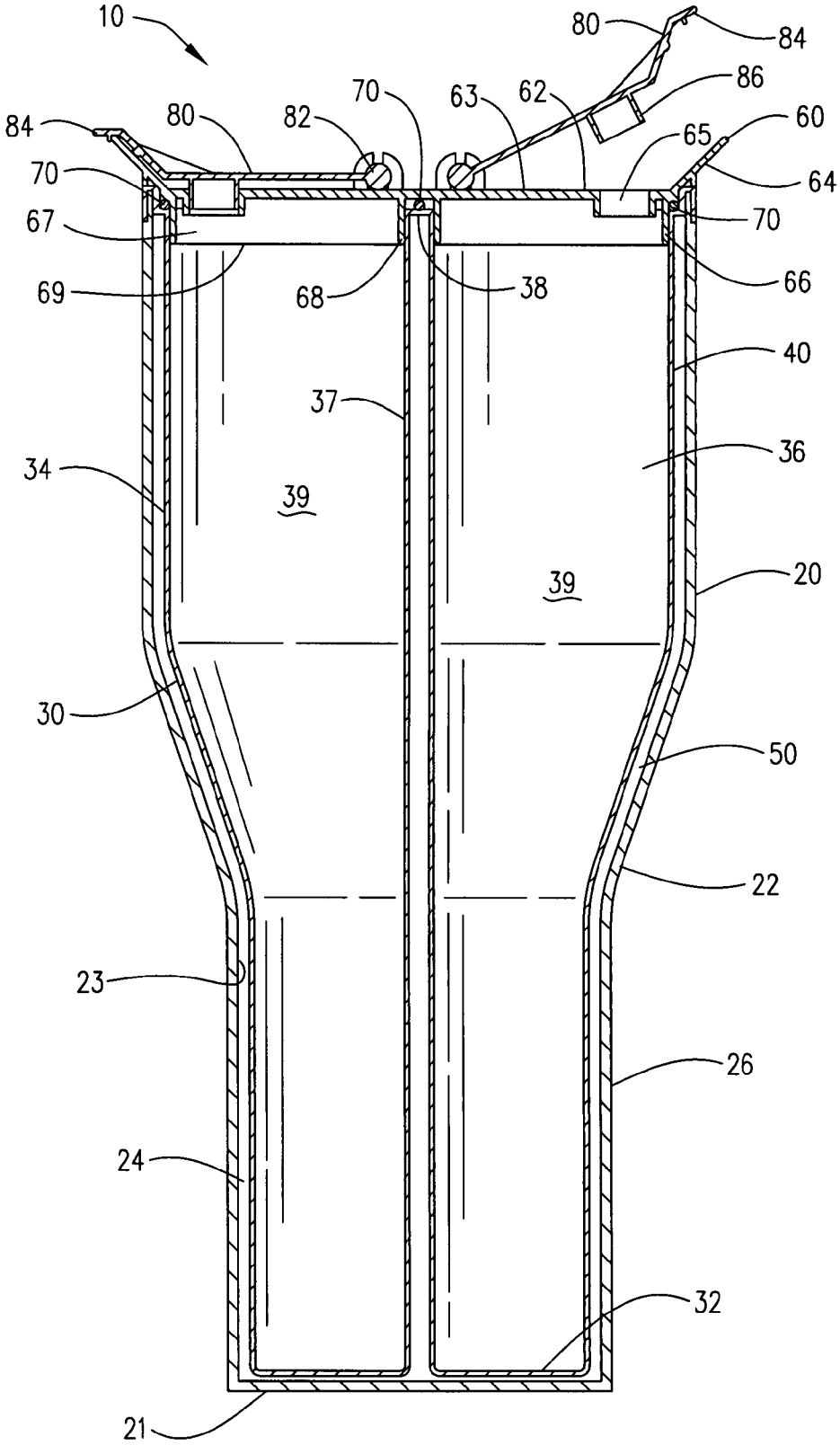
FIG. 3 is a side cross-sectional view of the beverage container in a line perpendicular to the vertical partition.
Figure 4:
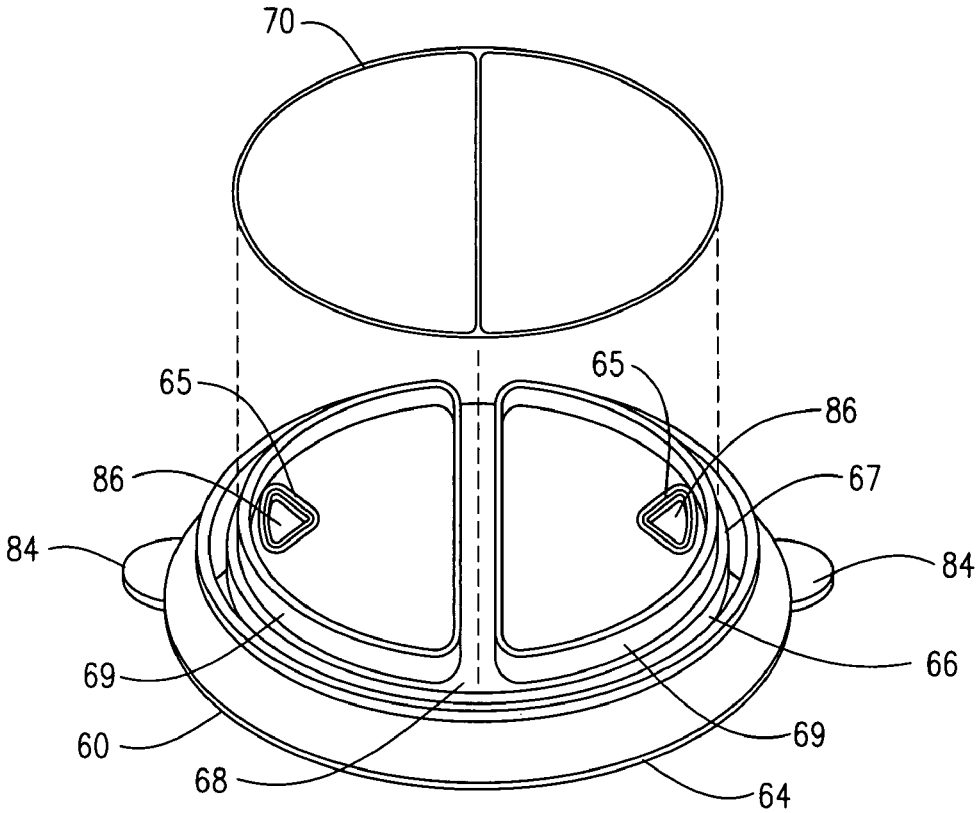
FIG. 4 is a bottom view of the lid member with indication of the placement of the seal member.
Figure 5:
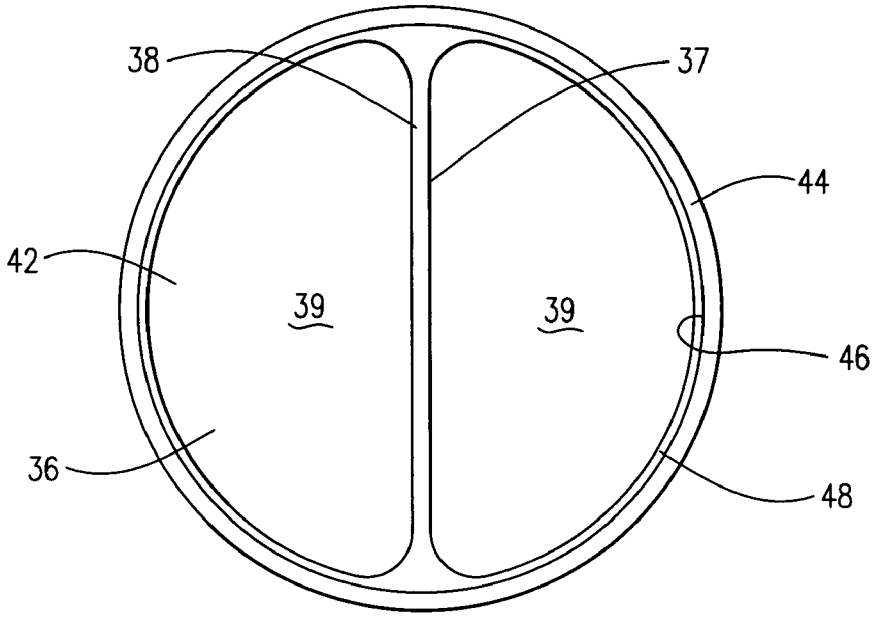
FIG. 5 is a top view of the inner liner of the beverage container without the lid member revealing the at least two segregated compartments.

A compartmentalized insulated beverage container 10 provides independent access to one or more liquid beverages within the container, as represented in FIGS. 1-5, the beverage container 10 comprising an outer container 20 having a bottom 21 and contiguous sides 22 having an outer surface 26 and an inner surface 23 defining a cavity 24, the sides 22 further defining an upper opening 28, an inner liner 30 having a bottom 32 and sides 34 defining an inner cavity 36 and an outer surface 40, the inner cavity 36 further providing an integrated vertical partition 37 having an expanded upper edge 38 which separates the inner cavity 36 into at least two segregated compartments 39, the sides 34 further defining an upper opening 42 having an outwardly extending flange 44 and an inner rim portion 46 having an upper shoulder margin 48, the outwardly extending flange 44 affixed to the upper opening 28 of the outer container 20 leaving a void 50 between the outer surface 40 of the inner liner 30 and the inner surface 23 of the outer container 20, a lid member 60 having an upper cap portion 62 defining an upper surface 63 with an elevated outer margin 64 and at least two access openings 65, a side extension 66 descending from the upper cap portion 62 of the lid member 60 conforming to the inner rim portion 46 of the inner liner 30 which secure the side extension 66 within the inner rim portion 46, and a lower portion 67 defining a partition socket 68 and at least two contoured protuberances 69 extending partially within each of the at least two segregated compartments 39 when the lid member 60 is engaged within the inner liner 30, the partition socket 68 engages the expanded upper edge 38 of the vertical partition 37 and the lower portion 67 is placed against the upper shoulder margin 48 of the inner rim portion 46 of the inner liner 30, a resilient and deformable seal member 70, FIG. 4, conforming to the side extension 66 of the lid member 60 and traversing across the partition socket 68 forming a liquid seal between the lid member 60 and the inner liner 30 to prevent leakage of liquid beverages contained with the inner liner 30 and between the at least two segregated compartments 39, and at least two closure members 80, each closure member 80 having a base end 82 hingably attached to the upper surface 63 of the lid member 60 and a tab end 84 defining a lower opening plug 86 which sealably engages each of the at least two access openings 65 in the lid member 60, each closure member 80 independently opening to provide drinking access to the liquid beverage contained within each segregated compartment 39 within the inner liner 30, FIG. 3.

Figure 1:
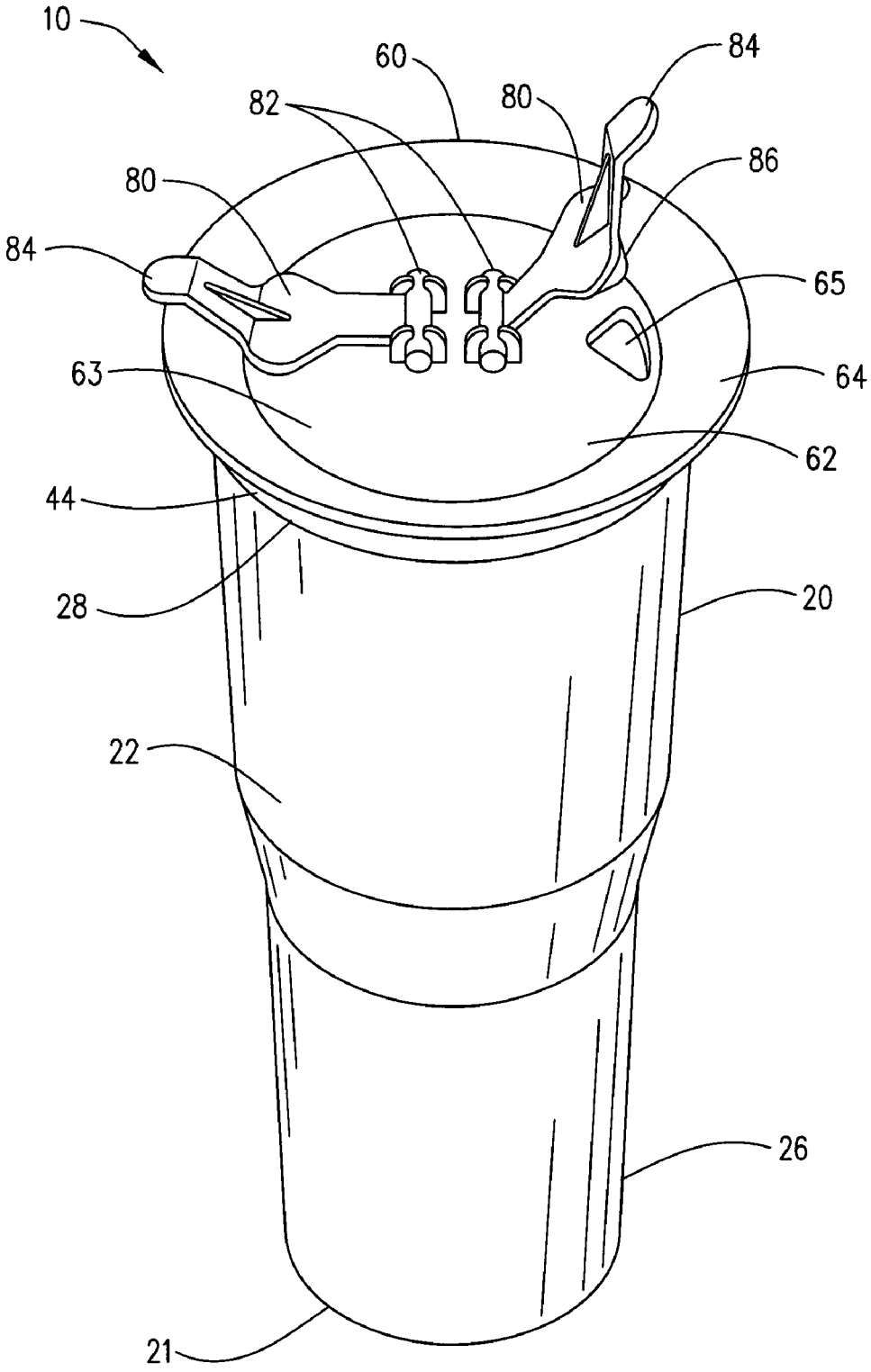
FIG. 1 is an upper perspective view of the beverage container with one closure member disengaged from the corresponding access opening.
Figure 2:
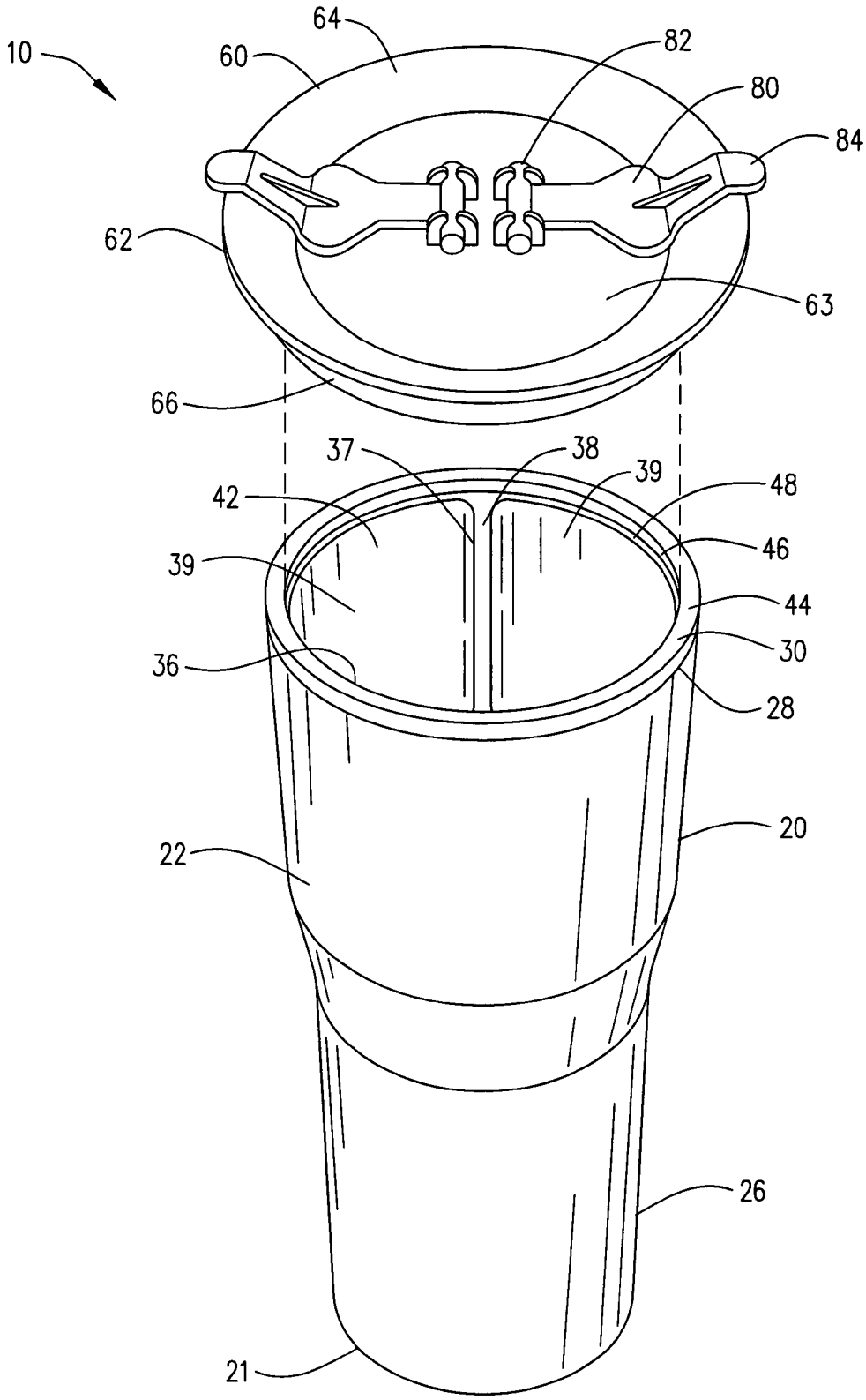
FIG. 2 is an upper perspective view of the beverage container with the lid disengaged revealing the inner liner and the segregated compartments.

It is important in defining the purpose of the segregated beverage container 10 that the liquid beverages contained therein remain completely segregated from one another without intrusion over or around the vertical partition 37 within the inner liner 30, do not leak from the beverage container 10 when the lid member 60 is engaged within the inner liner 30 and the segregated compartments 39 are isolated with independent access to each liquid beverage in each segregated compartment 39 by independently opening closure members 80, allowing one liquid beverage to be consumed from a selected segregated compartment 39 at a time, as indicated in FIGS. 1 and 3.

Depending on the size of the beverage container 10, the beverage container may have more than two segregated compartments 39 within the inner liner 30. The number of access openings 65 in the lid member 60, the number of contoured protuberances 69 extending from the lower portion 67 of the lid member 60, the and the number of closure members 80 would be need to be equal to the number of segregated compartments 39. The seal member 70 would also have to be adapted to the number of the contoured protuberances 69 and the shape of the partition socket 68. The beverage container may be made from liquid resistant metal, plastic, rubber or a combination of materials as deemed appropriate for the manufacturing and marketing requirements of the beverage container. The drawing figures indicate two segregated compartments 39, two access openings 65, two contoured protuberances 69 in the lid member 30 and two closure members 80, but only insofar as to illustrate one embodiment of the compartmentalized beverage container 10.

The inner rim portion 46 of the inner liner 30 may also include a plurality of extending projections comprising circumferential rings, or may be provided as spiral threads adapted to engage a threaded indentation within the side extension 66 of the lid member 30 to further provide a leak proof seal between the lid member 60 and the inner liner 30, not shown in the drawing figures.

It is contemplated within the scope of this beverage container 10 that any of the several different closure means disclosed in the prior art may be used including slide type member, a rotating closure means or a closure which is attached to the lid by a lanyard with a plug which is adapted to be inserted within the access openings 65 in the lid member 30. In addition, the beverage container 10 may undergo improvements and modification due to manufacturing requirements, economical factors or reduction of production concerns when making the compartmentalized beverage container.

While the invention has been particularly shown and described with reference to a preferred embodiment thereof, it will be understood by those skilled in the art that changes in form and detail may be made therein without departing from the spirit and scope of the invention.

What is claimed is:

1. A compartmentalized insulated beverage container provides independent access to one or more liquid beverages within the container, the beverage container comprising:

an outer container having a bottom and contiguous sides defining an outer surface and an inner surface, said sides further defining a cavity and an upper opening;

an inner liner having a bottom and contiguous sides defining an inner cavity and an outer surface, said inner cavity providing an integrated vertical partition having an expanded upper edge which separates said inner cavity into at least two segregated compartments, said sides further defining an upper opening;

a lid member having and upper surface and a lower portion defining a partition socket and at least two contoured protuberances extending into each said at least two segregated compartments when said lid member is engaged within said inner liner, said partition socket engaging said expanded upper edge of said vertical partition;

a resilient and deformable seal member conforming to said lower portion and said partition socket forming a liquid beverage seal between said lid member and said inner liner and between said at least two segregated compartments when said lid member is inserted within said inner liner; and at least two closure members, each said closure member having an opening plug attached to said lid member, each said closure member attached to said upper surface of said lid member, each said opening plug sealably engaging one of at least two access openings in said lid member, each said at least two closure members independently opening to provide drinking access to said liquid beverage contained within each said segregated compartment within said inner liner.

2. The beverage container as disclosed in claim 1, said sides of said inner liner further comprising an outwardly extending flange and an inner rim portion having an upper shoulder margin, said outwardly extending flange affixed to said upper opening of said outer container defining a void between said outer surface of said inner liner and said inner surface of said outer container.

3. The beverage container, as disclosed in claim 1, further comprising:

said lid member defines an upper cap portion defining an upper surface, an elevated outer margin and said at least two access openings, a side extension descending from said cap portion of said lid member adapted to be inserted within an inner rim portion of said inner liner wherein a liquid beverage seal is further provided when said lower portion is placed against an upper shoulder margin of said inner rim portion of said inner liner; and said seal member engages said side extension of said lid member and traverses said partition socket forming a liquid barrier between said lid member and said inner liner preventing leakage of liquid beverages contained within said inner liner and between said segregated compartments.

4. The beverage container as disclosed in claim 1, wherein each of said at least two closure members further comprises a base end hingably attached to said upper surface of said lid member and a tab end defining said lower opening plug which sealably engages each of said at least two access openings in said lid member, each closure member independently opening to provide drinking access to a liquid beverage contained within each said segregated compartments within said inner liner.

5. A compartmentalized insulated beverage container provides independent access to the one or more liquid beverages within the container, the beverage container comprising:

an outer container having a bottom and contiguous sides defining an outer surface and an inner surface, said sides further defining a cavity and an upper opening;

an inner liner having a bottom and contiguous sides defining an inner cavity and an outer surface, said inner cavity providing an integrated vertical partition having an expanded upper edge which separates said inner cavity into at least two segregated compartments, said sides further defining an upper opening having an outwardly extending flange and an inner rim portion having an upper shoulder margin, said outwardly extending flange affixed to said upper opening of said outer container defining a void between said outer surface of said inner liner and said inner surface of said outer container;

a lid member having an upper cap portion defining an upper surface, an elevated outer margin and at least two access openings, a side extension descending from said cap portion of said lid member adapted to be inserted within an inner rim portion of said inner liner, and a lower portion defining a partition socket and at least two contoured protuberances extending into each said at least two segregated compartments when said lid member is engaged within said inner liner, said partition socket engaging said expanded upper edge of said vertical partition and said lower portion is placed against an upper shoulder margin of said inner rim portion of said inner liner;

a resilient and deformable seal member conforming to said side extension of said lid member and across said partition socket forming a liquid barrier between said lid member and said inner liner preventing leakage of liquid beverages contained in said inner liner and between said segregated compartments; and at least two closure members, each said closure member having an opening plug attached to said lid member, each said closure member attached to said upper surface of said lid member, each said opening plug sealably engaging one of at least two access openings in said lid member, each said at least two closure members independently opening to provide drinking access to said liquid beverage contained within each said segregated compartment within said inner liner.

6. The beverage container as disclosed in claim 5, wherein each of said at least two closure members further comprises a base end hingably attached to said upper surface of said lid member and a tab end defining said lower opening plug which sealably engages each of said at least two access openings in said lid member, each closure member independently opening to provide drinking access to a liquid beverage contained within each said segregated compartments within said inner liner.

* * * * *